US005678656A

United States Patent [19]

Lanzafame

[11] Patent Number: 5,678,656

[45] Date of Patent: Oct. 21, 1997

[54] POSITIVE ENGAGING LADDER STABILIZING AND LEVELING DEVICE

[76] Inventor: Philip F. Lanzafame, 18350 Fjord Dr. NE., Poulsbo, Wash. 98370

[21] Appl. No.: 506,688

[22] Filed: Jul. 25, 1995

[51] Int. Cl.[6] ..... E06C 7/44

[52] U.S. Cl. ..... 182/205; 182/111

[58] Field of Search ..... 182/205, 214, 182/108, 111, 200, 201, 204; 248/188.5, 188.9, 903, 188.2

[56] References Cited

U.S. PATENT DOCUMENTS

| | | | |
|---|---|---|---|
| 979,821 | 12/1910 | Brasington | 182/205 |
| 1,329,740 | 2/1920 | Barron . | |
| 1,733,338 | 10/1929 | Enke | 182/204 |
| 1,887,495 | 11/1932 | Carter, Jr. | 182/205 |
| 3,406,785 | 10/1968 | Pilcher | 182/205 |
| 4,014,406 | 3/1977 | Easton | 182/204 |
| 4,147,231 | 4/1979 | Chantler et al. . | |
| 4,606,432 | 8/1986 | Belt | 182/204 |
| 4,607,726 | 8/1986 | Davis et al. | 182/204 |
| 5,027,923 | 7/1991 | Derome . | |

*Primary Examiner*—Alvin C. Chin-Shue
*Attorney, Agent, or Firm*—Graybeal Jackson Haley LLP

[57] ABSTRACT

The present invention provides a ladder stabilizing and leveling device (21) that includes an outer housing (41) substantially fixed with respect to a ladder rail (29), and an inner housing (41) that is movable within the outer housing (41) from a retracted position to an extended position. The present invention includes a positive locking engagement system wherein the greater the force applied to the ladder rail (29), the greater the force applied to the locking engagement between the outer housing (41) and the inner housing (21). A safety bar (117) interconnects a support foot (27) and a lock block (73) wherein force applied to the support foot (27) locks the lock block (73) in position. The present invention also includes a retraction spring (53) that continually applies an upward biasing force on the inner housing (71). In addition, the present invention provides an interconnecting relationship between the outer housing (41) and the inner housing (71) wherein various ribs (111) are provided on the outer rails (89) of the inner housing (71) where the outer rails (89) contact the inner surface of the outer housing (41); this feature of the present invention allows debris, or other foreign particles, to pass substantially downward and exit the ladder stabilizing and leveling device (20).

8 Claims, 5 Drawing Sheets

POSITIVE ENGAGING LADDER STABILIZING AND LEVELING DEVICE

FIELD OF THE INVENTION

The present invention generally relates to ladder stabilizing and leveling devices, and more particularly relates to a ladder rail extension device with a positive engagement locking system.

BACKGROUND OF THE INVENTION

Ladders are commonly used on uneven or sloped terrain where conditions may exist that render a conventional ladder dangerously unstable; this increases the probability of an accident or serious injury to the user. To overcome this hazardous condition, various stabilizing and leveling devices have been suggested in the prior art. The most common ladder stabilizing device generally consists of a long pair of stabilizing legs, hingely secured to an upper portion of the ladder. During use, the stabilizing legs are pivoted outward and toward the object against which the ladder is resting; the stabilizing legs are then locked in place. When not in use, the stabilizing legs are folded against the ladder rails for convenient transportation and storage. This stabilizing device, while very secure once deployed, can only be used if there is sufficient area surrounding the base of the ladder, and the surface on which the ladder rests is substantially horizontal and level. This type of stabilizing device cannot always be positioned to compensate for uneven terrain.

A second type of ladder stabilizing and leveling device consists primarily of a pair of telescopic rods secured to either side of the ladder, preferably to the ladder's side rails. At the end of each rod is usually secured a support foot for resting on and providing limited-slip contact with a surface the ladder is resting on. Accordingly, with the use of a set screw, the rods and associated support feet can be extended downward independently of one another, allowing the user to change the base configuration of the individual ladder rails. More specifically, a user can extend or retract one of the rods (or both) to compensate for uneven terrain.

A good example of such a device is shown in U.S. Pat. No. 4,995,474 (1991) to Gauthier. This patent proposes a ladder having at least two rails with stabilizing and leveling capabilities. The method of adjustment is by means of a threaded rod positioned in the ladder rail. In order to make adjustment to the ladder rail length, the user manually spins the extension device into or out of the ladder rail. The stabilizing and leveling device of the Gauthier patent must be adjusted with one hand while holding the ladder in a vertical position with the other hand; this can be difficult and cumbersome in certain conditions. In addition, since the device is an integral part of the ladder rail, the user must purchase the entire ladder to possess the benefits of the stabilizing and leveling device.

U.S. Pat. No. 5,027,923 to Derome shows an extension device for a ladder that includes a housing and an extendable or retractable leg, i.e., ladder rail. The housing is clamped to the ladder rail wherein the ladder rail can be extended or retracted to provide the best stability base, presumably a level configuration, for the ladder. This patent shows the use of a locking mechanism that can be engaged and disengaged once weight has been removed from the ladder rail. In addition, this patent shows the use of a bubble level positioned on the ladder to visually observe the level status of the ladder.

U.S. Pat. Nos. 5,341,899 and 5,154,257 both show alternative ladder stabilizing and leveling devices. U.S. Pat. No. 5,154,257 provides an adjustable ladder leveling device that includes a housing (tube) fixed to the ladder and a moveable portion adjustable within the housing. Accordingly, a set screw can be adjusted to release or securely fasten the moveable portion within the housing.

U.S. Pat. No. 5,341,899 shows a ladder stabilizing and leveling device that includes a pair of guide rails along which an upper carriage and a lower carriage slide independently. The upper carriage provides a mounting platform onto which a brace is rotatably mounted. When pivoted to a specified angle and lowered so as to contract the resting surface, the brace prevents the ladder from skidding away from the object on which the ladder is resting. A self-locking mechanism employing a series of detents is used to secure the upper carriage in a stationary position. The lower carriage provides a mounting platform for the support foot and can be adjusted along the guide rails to provide height adjustment for the support foot. Once adjusted, a self-locking mechanism employing the detents secures the lower carriage in a stationary position with respect to the guide rails. An incline indicator is attached to the guide rail to assist in setting the ladder at the proper incline.

All of the above mentioned devices provide some type of ladder stabilizing and leveling device, however, there is a need for a more positive engagement locking system that better insures the stability and safety of the ladder. Specifically, there is a need for a ladder stabilizing and leveling device that does not inadvertently slip or disengage when contacted by external forces, or as a result of the ladder shifting. There is also a need for readily retrofitting a ladder stabilizing and leveling device to an existing ladder, the device being lightweight, easily adjustable and compact. Accordingly, the present invention provides an easily retrofitable ladder stabilizing and leveling device that includes these features in a positive engagement locking system.

SUMMARY OF THE INVENTION

The present invention achieves numerous advantages over prior art ladder stabilizing and leveling devices by providing a lightweight, compact and easily adjustable ladder stabilizing and leveling device with a positive engagement locking system. The present invention is easily secured to a conventional ladder and can be easily adjusted to lengthen or shorten a ladder rail for stabilizing and leveling the ladder on various surfaces. The device of the present invention may be attached to the ladder rail of a conventional ladder or integrally incorporated into the ladder rail.

The stabilizing and leveling device of the present invention preferably includes an outer housing securable to at least one ladder rail. The outer housing, in the preferred embodiment, has secured therein a series of locking nubs for being positively engaged by at least one spring biased lock block. The outer housing is preferably configured for matingly engaging an inner housing, the inner housing adapted to slide longitudinally within the outer housing to lengthen or shorten the ladder rail; the lock block positively engaging the locking nubs when the desired configuration is achieved. In use, an operator manually releases the lock block from the locking hubs by applying a downward force to a release lever secured to the lock block. Accordingly, the inner housing can be extended or retracted with respect to the outer housing to a desired ladder stabilizing and leveling position. The lock block can then be released to positively engage the locking hubs secured within the outer housing.

In a preferred embodiment of the present invention, there is provided a retraction spring secured to both the outer housing and the inner housing. The retraction spring applies a continually upward biasing force on the inner housing which, once the lock block has been released from the locking nubs, has a natural tendency to retract the inner housing into the outer housing for storage or otherwise non-use of the ladder.

Also, the present invention includes a safety feature wherein the support foot of the ladder is preferably mechanically connected to a sliding safety bar. When pressure is applied to the support foot, the safety bar slides upward to mechanically lock the lock block in position, specifically from rotating to a disengaged position; this increases the safety of the ladder stabilizing and leveling device and further prevents inadvertently disengaging the lock block from the locking hub rail.

The present invention in an alternative embodiment, also includes a self-cleaning feature that facilities the removal of debris and other foreign particles that would otherwise interfere with the extension and retraction of the inner housing out of and into the outer housing. More specifically, the inner housing includes a plurality of individual ribs for contacting the inner surface of the outer housing. Accordingly, any debris or other particles that inadvertently enter the interface between the inner housing and the outer housing migrate to the gaps between the plurality of ribs and exit the ladder stabilizing and leveling device at its bottom portion without interfering with the operation of the inner housing with respect to the outer housing. This feature is equally applicable to grooves or ridges being provided in the locking nub rail wherein particles have a natural tendency to migrate downward through the grooves and exit at the bottom portion of the ladder stabilizing and leveling device.

The advantages of the present invention are inherent in the ease of securing the ladder stabilizing and leveling device to a conventional ladder, the ease with which the ladder leveling and stabilizing device may be adjusted, the self retracting of the lower housing into the upper housing, its lightweight and compact design, the safety feature preventing inadvertently disengaging the lock block from the locking hubs, and the positive locking engagement system of the lock block into the locking nubs.

BRIEF DESCRIPTION OF THE DRAWINGS

A better understanding of the invention and its advantages may be obtained from the detailed description given below of the preferred embodiments taken in conjunction with the accompanying drawings in which.

DETAILED DESCRIPTION OF THE PREFERRED EMBODIMENT

For purpose of describing the embodiments of the present invention, including the preferred embodiment, a ladder stabilizing and leveling device will be described as it would be secured to at least one ladder rail 29 of a conventional ladder 21. It will be readily apparent to those skilled in the art that the ladder stabilizing and leveling device may be attached to all types of ladders and, in some circumstances, may be equally applicable to scaffolding (not shown) or other apparatuses that require stabilizing and leveling devices for safe and efficient use.

The ladder stabilizing and leveling device of the present invention is preferably constructed of a lightweight metal and/or metal alloy, however, those skilled in the art may choose to incorporate other materials including, but not limited to, plastics with metal hardened inserts in high-stress areas. Again, it will be readily apparent to those skilled in the art what is the best fabrication design for a specific application.

The following detailed description of the ladder stabilizing and leveling device of the preferred embodiment of the present invention will be described in terms of having a top, a bottom, a front and a back. For descriptive purposes, the bottom portion of the ladder stabilizing and leveling device will be that portion most closely associated with a contact surface 25, specifically the ground or floor on which the ladder stabilizing and leveling device is resting. The top portion will be that portion opposite the bottom portion and presumably closer to an upper end portion of the ladder 21 with the ladder 21 in a substantially upright vertical position resting against an object. The back portion of the ladder stabilizing and leveling device will be that portion contacting and preferably being secured to the ladder rail 29. The front portion will be that portion opposite the back portion and being the outer most portion of the ladder.

Figure 1A:
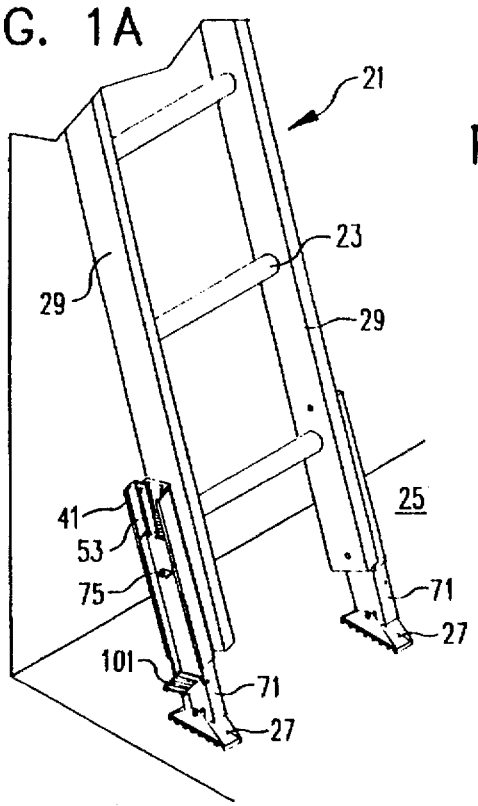
FIG. 1A is a perspective view of the ladder stabilizing and leveling device of the present invention attached to a conventional ladder rail showing the inner housing partially extended from the outer housing.
Figure 1B:
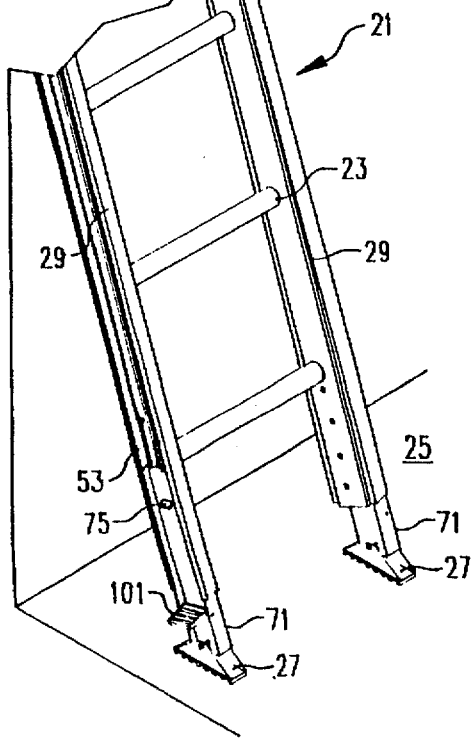
FIG. 1B is a perspective view of the ladder stabilizing and leveling device of the present invention integrally incorporated into a lower portion of a ladder rail showing the inner housing partially extended from the outer housing.

Referring now to FIGS. 1A and 1B, the present invention is shown in two alternative embodiments. Specifically, FIG. 1A shows the present invention adapted to a ladder rail 29 of a conventional ladder 21 having ladder rungs 23. The device of the present invention may be secured to the ladder 21 using various fasteners including, but not limited to, bolts, rivets, screws and/or straps (described in greater detail below).

Alternatively, and as shown in FIG. 1B, the ladder stabilizing and leveling device may be integrally incorporated into the ladder rail 29. In this alternative embodiment, the weight of the ladder 21 may be reduced in that the ladder stabilizing and leveling device is not attached to the ladder rail 29 at its lower end portion but rather replaces the ladder rail 29 at its lower end portion. In addition, by integrally incorporating the ladder stabilizing and leveling device into the ladder 21, the ladder 21, as a whole, may be more compact, easily managed, stored and transported. This would be a task specific design objective readily apparent to those skilled in the art.

Figure 2:
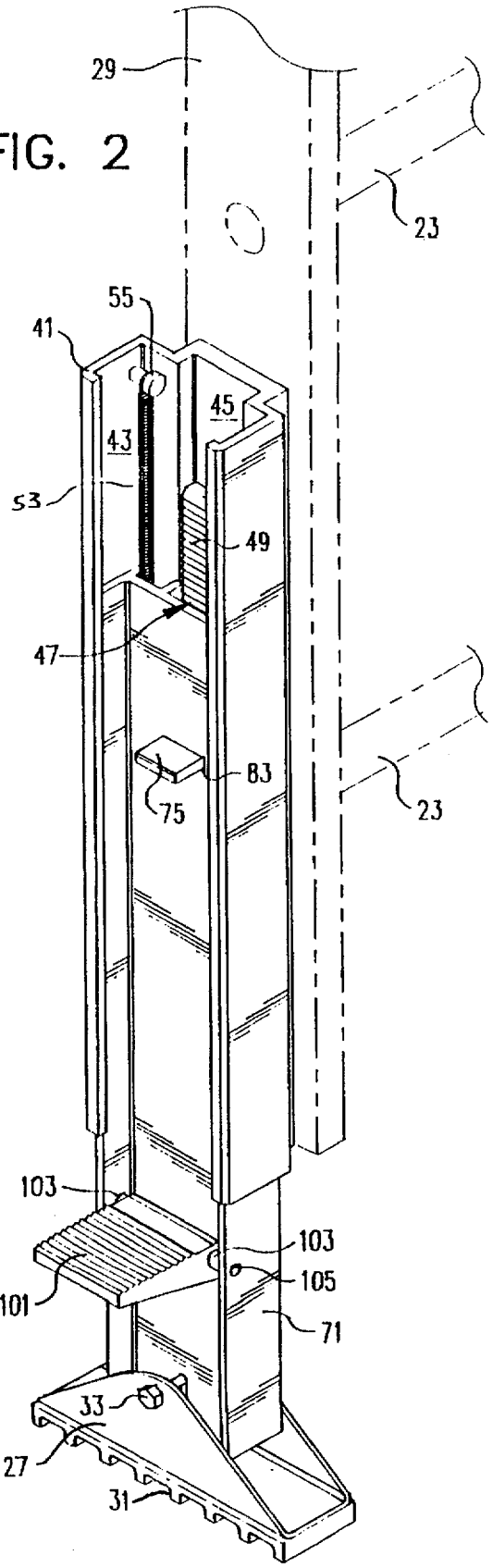
FIG. 2 is a side perspective view of a preferred embodiment of the present invention showing the inner housing partially extended from the outer housing exposing the locking hubs secured to an inner surface of the outer housing.

FIG. 2 is an enlarged view of the ladder stabilizing and leveling device as shown in FIG. 1A and FIG. 1B. FIG. 2 shows the positioning of a release pedal 101, a retraction spring 53 and a lock block release lever 75. In the preferred embodiment, a support foot 27, presumably the same support foot 27 that would be secured to a conventional ladder rail 29, is secured to the bottom portion of an inner housing 71 of the ladder stabilizing and leveling device. In this regard, as the inner housing 71 extends and retracts within the outer housing 41, the support foot 27 likewise extends and retracts thereby lengthening or shortening the ladder rail 29 accordingly. In the preferred embodiment of the present invention, the inner housing 71 is an I-beam having outer rails 89 and a connecting I- beam web 121.

Figure 3:
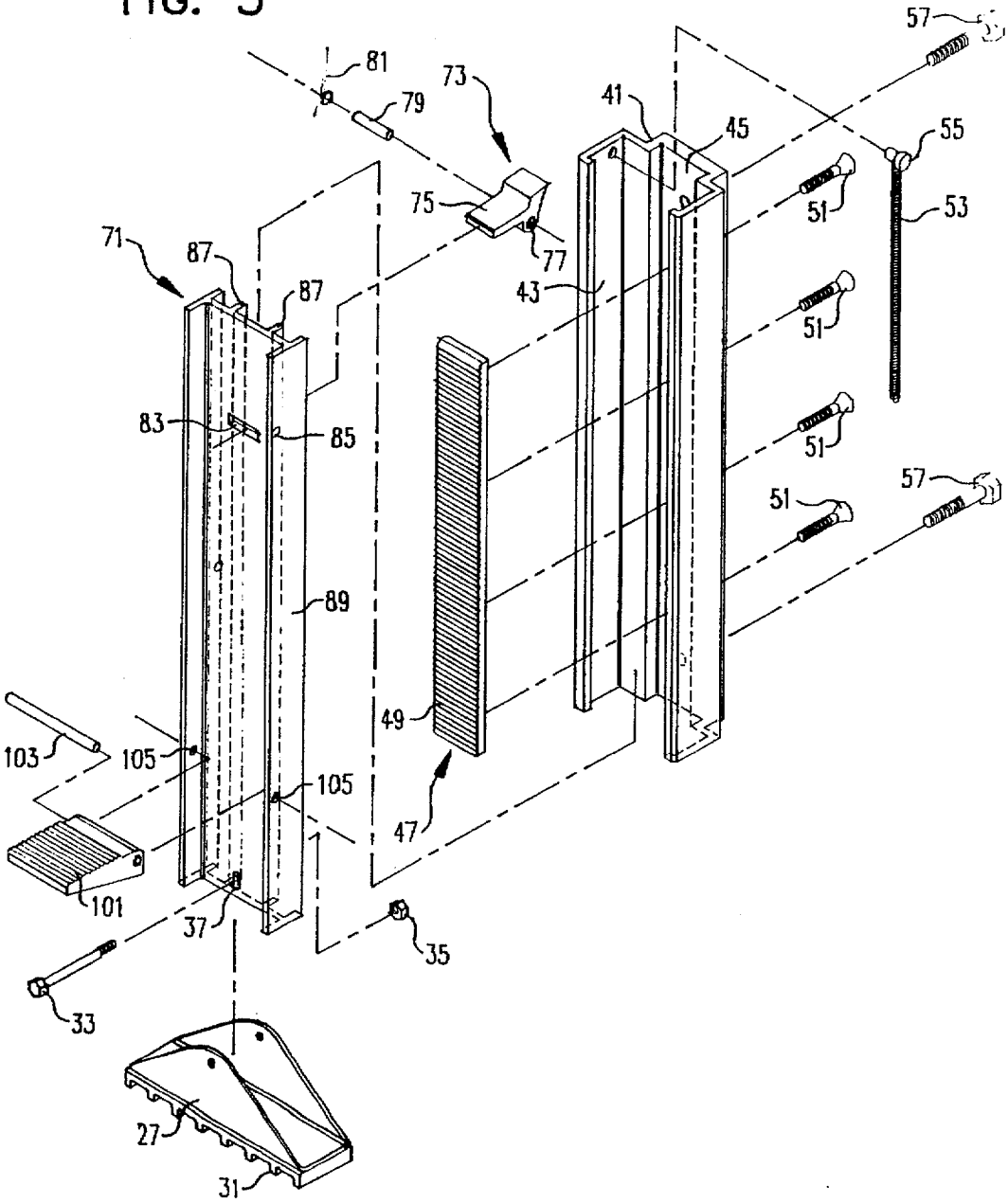
FIG. 3 is an exploded perspective view of the preferred embodiment of the present invention illustrating the various (lips) components of the ladder stabilizing and leveling device and their respective association therewith.

FIG. 3 is an exploded view of the ladder stabilizing and leveling device of the present invention showing various components as they relate to one another and would accordingly be assembled. The primary components of the ladder stabilizing leveling device include, first, an outer housing 41 for being secured to the ladder rail 29 and for being matingly engaged by the inner housing 71 and, second, an outer housing channel 43 for slidably engaging rails 89 of the inner housing 71. The inner housing 71 is slidable within the outer housing 41 in a substantially vertical direction, or otherwise longitudinally direction with respect to the ladder rail 29, from a completely retracted position wherein the inner housing 71 is substantially contained within the outer housing 41, to a fully extended position wherein the inner housing 71 extends as much as possible from the outer housing 41. The extension of the inner housing 71 from the outer housing 41 is a design criteria based on material integrity and fabrication design; this would be readily apparent to those skilled in the art.

The outer housing 41, in addition to the outer housing channel 43, also includes a locking nub rail channel 45. A locking hub rail 47 is securely mounted within the locking hub rail channel 45 using locking hub rail fasteners 51. The locking nub rail fasteners 51 may be, but are not limited to, screws, bolts, rivets, or fusion welding. In this configuration, the locking nub rail 47 remains substantially behind or in back of the inner housing 71, thereby not interfering with the sliding movement of the inner housing 71 within the outer housing 41.

It will be readily apparent to those skilled in the art that the configuration of the outer housing 41 and the mating engagement of the inner housing 71 may be reconfigured to reposition the locking nub rail 47 other than in back of the outer housing 41. Specifically, the locking hub rail 47 may be positioned on either side of the outer housing 41 or in the front of the outer housing 41 (assuming the outer housing is not partitioned as shown in the preferred embodiment of the present invention). The outer housing 41 is preferably secured to the outer ladder rail 29 using fastening bolts 57.

Secured to the upper portion of the outer housing 41, as shown in FIG. 2 and FIG. 3, is a retraction spring 53. In the preferred embodiment, one end of the retraction spring is secured to a top portion of the outer housing 41 with a retraction spring fastener 55. The other end of the retraction spring 53 is secured to the inner housing 71 such that the retraction spring 53 is continually applying an upward biasing force on the inner housing 71 thereby facilitating the retraction of the inner housing 71 into the outer housing 41; this configuration assists the user in retracting the inner housing 71 into the outer housing 41 when the ladder 21 is being reconfigured for storage or otherwise non-use. The retraction spring 53 may be secured anywhere along the length of the inner housing 71 with an appropriate fastener (not shown).

With reference to FIG. 3, the present invention utilizes the support foot 27 of a conventional ladder rail 29. The support foot 27 is preferably secured to the bottom portion of the inner housing 71 with a securing bolt 33, passing through an oblong securing bolt aperture 37, and a securing nut 35. The support foot 27 generally includes a friction pad 31.

Also shown in FIG. 3 is a safety bar 117 which is movably positioned between a back portion of the I-beam web 121 and safety bar guide ribs 119 perpendicularly secured to the lock block mounting ribs 87. In this regard, the safety bar has an aperture 123 with a diameter slightly larger than the outside diameter of the friction pad securing bolt 33. The friction pad securing aperture 37 in the I-beam web 121 is oblong in that the length dimension of the friction pad securing aperture 37 is significantly greater than the width dimension of the friction pad securing aperture 37, the width dimension being slightly larger than the outside diameter of the friction pad securing bolt 33. Accordingly, when the support foot 27 is secured to the ladder stabilizing and leveling device the friction pad securing bolt 33 remains free to move in a longitudinal direction with respect to the I-beam web 121. Because the safety bar 117 is secured to the friction pad securing bolt 33, when pressure is applied to the support foot 27, the support foot 27 and friction pad securing bolt 33 move in a substantially upward longitudinal direction until the friction pad securing bolt 33 contacts an upper portion of the elongated friction pad aperture 37. This movement of the friction pad securing bolt 33 similarly causes the safety bar 117 to move in a substantially upward longitudinal direction wherein the upper portion 125 of the safety bar 117 contacts the lock block 73 (discussed in greater detail below).

Figure 4:
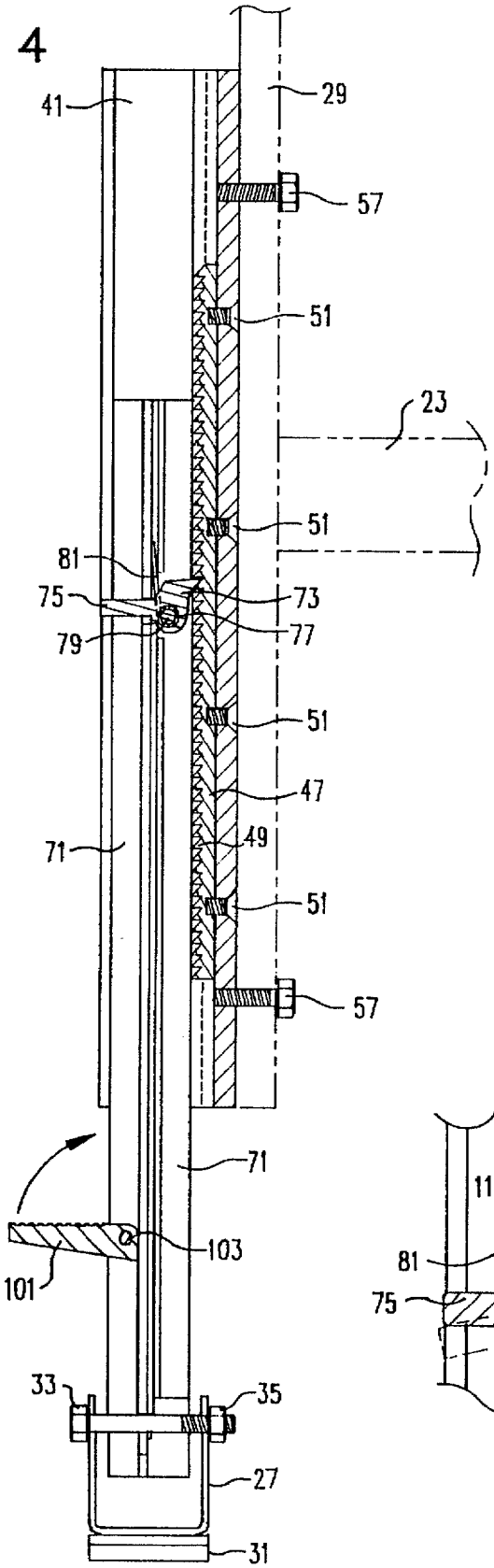
FIG. 4 is an elevational view in partial cross-section of the preferred embodiment of the present invention showing the lock block secured to the inner housing, positively engaging the locking hubs secured to the inner surface of the outer housing.
Figure 5:
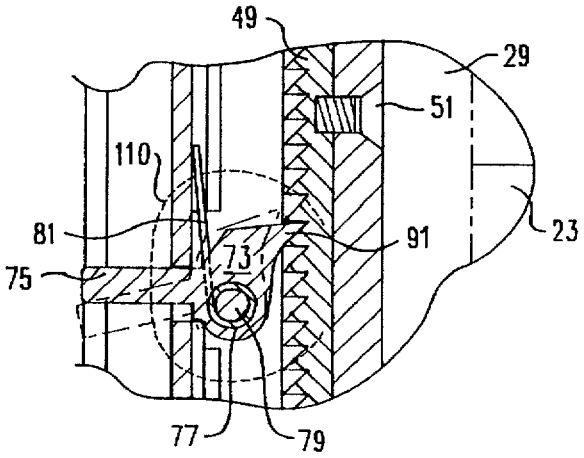
FIG. 5 is an enlarged elevational view in partial cross-section of the lock block engaging the locking hubs as similarly shown in FIG. 4.

Referring specifically to FIG. 4 and FIG. 5, the positive locking engagement system of the inner housing 71 within the outer housing 41 is shown in greater detail. The positive engaging locking system includes a lock block 73, a lock block release lever 75 and a lock block biasing spring 81. Preferably, the lock block 73 and the lock block release lever 75 are forged as an integral component, however, it will be readily apparent to those skilled in the art that the lock block 73 may be manufactured independently and configured differently than that shown in the preferred embodiment of the present invention and that a lock block release lever 75 may be attached by any appropriate means.

In addition, the lock block release lever 75 may be replaced with an alternative release means that is presumably connected to the lock block 73 by some type of mechanical means. As a task specific feature, it may be necessary to eliminate the lock block release lever 75 and relocate it to an alternative position interconnecting the lock block release lever 75 and the lock block 73 by alternative mechanical means.

The lock block 73 is fastened to the inner housing 71 with a lock block pivoting pin 79. The inner housing 71, as more clearly shown in FIG. 3, preferably includes look block mounting ribs 87. Accordingly, the lock block 73 is positioned between the lock block mounting ribs 87, the lock block pivoting pin 79 passing through apertures 85 in the lock block mounting ribs 87 and also, preferably, passing through apertures 85 in the outer rail portions 89 of the inner housing 71 to further support the lock block 73. The lock block pivoting pin 79 may be secured in place using snap rings, a pressed fit into either the aperture 85 or the lock block 73, or any other suitable means of pivotally securing the lock block 73 within the inner housing 71. As shown in FIG. 3, the lock block release lever 75 preferably protrudes through a lock block release lever aperture 83. The lock block release lever 75 is thus accessible to a user from the front portion of the ladder stabilizing and leveling device.

The locking hub rail 47 secured to the outer housing 41 preferably includes locking nubs 49. In this regard, the lock block 73, which includes a locking tip 91, is bias inward toward the locking nubs 49 by a lock block biasing spring 81. While the preferred embodiment of the present invention includes the lock block 73 with the locking tip 91 (for being secured within the locking hubs 49), it will be readily apparent to those skilled in the art that alternative methods of securely locking the inner housing 71 into the outer housing 41 may be used. More specifically, it is the intent of the present invention to disclose a positive locking engagement system wherein the greater the downward force applied to the outer ladder rails 29, the greater the engagement force between the inner housing 71 and the outer housing 41, specifically between the locking tip 91 and the locking nubs 49. In addition, the positive locking engagement system of the present invention can not be inadvertently disengaged by the ladder shifting or objects coming into contact with the lock block.

As is best shown in FIG. 5, as the lock block 73, using the lock block release lever 75, rotates about the lock block pivot pin 79, the locking tip 91 rotates in an arc 110 about the lock block pivot pin 79, the arc 110 intersects the locking nub rail 47 and more specifically the locking hubs 49. Accordingly, as force is applied downward on the locking tip 91—as a result of weight being applied to the ladder rail 29—the lock block 73, as a function of pressure being applied to the locking tip 91, is forced in a clockwise rotation about the lock block pivot pin 79. This clockwise rotation in turn increases the applied force of the locking tip 91 into the locking nubs 49 as a function of the locking tip 91 traversing the arc 110 that intersects the locking nubs 49. In this regard, the present invention provides a positive locking engagement system wherein the greater the downward force applied to the ladder rail 29, the greater the applied force between the locking tip 91 and the locking hubs 49. This particular feature of the present invention ensures that the inner housing 71 will not inadvertently retract into the outer housing 41 either as a function of too much weight being applied to the ladder 21, the ladder 21 shifting or because of various objects coming into contact with the lock block 73 and/or the lock block release lever 75.

When there is no or very little downward force on the ladder rail 29, or otherwise upward force being applied to the inner housing 71, the locking tip 91 can be easily rotated out of the plane of contact between the locking tip 91 and the locking nubs 49 using the lock block release lever 75. Accordingly, the inner housing can be extended from or retracted into the outer housing 41. When it is desired to lock the inner housing 71 into position with respect to the outer housing 41, the operator merely releases the lock block release lever 75 allowing the locking tip 91 to enter the plane of contact between the locking tip 91 and the locking nubs 49. In order to release the locking tip 91 from the locking nubs 49, it is required that the user remove the weight from the ladder and simultaneously push downward on the lock block release lever 75. The locking tip 91 thus disengages from the locking nubs 49 allowing the inner housing 71 to be extended or retracted with respect to the outer housing 41.

A significant safety advantage of the present invention, as is best seen in FIG. 5, includes the locking of the lock block 73 in place by the safety bar 117, or more specifically, the prevention of rotation of the lock block 73 when weight is applied to the support foot 27. As shown in FIG. 5, the lock block 73 includes a lock ridge 127. In operation, when there is no weight applied to the ladder 21, hence the ladder stabilizing and leveling device, the support foot 27 and the safety bar 117, as a function of gravity, move downward. Accordingly, this downward movement causes the upper portion 125 of the safety bar 117 to disengage from the lock ridge 127. The lock block 73, specifically the locking tip 91, is then free to rotate to disengage the locking tip 91 from the locking nubs 49 of the locking hub rail 47. Alternatively, when a downward force is applied to the ladder 21, hence the ladder stabilizing and leveling device, both the support foot 27 and the safety bar 117, move in a substantially upward direction. The upper portion 125 of the safety bar 117 then contacts the locking ridge 127 of the lock block 73 assuming the lock block 73 has rotated into the engaged position as shown in FIG. 5. In this regard, the greater the pressure applied to the support foot 27, the more securely the lock block 73 is held in place by the safety bar 117.

It would be readily apparent to those skilled in the art that alternative means of mechanically linking the support foot 27 or other portions of the ladder stabilizing and leveling device to the lock block 73 wherein as weight is increased or initially applied to the ladder 21, hence the ladder stabilizing and leveling device, the locking tip 91 of the lock block 73 will remain securely engaged within the locking nubs 49 of the locking nub rail 47.

To facilitate the extension and retraction of the inner housing 71 into and out of the outer housing 41, the present invention includes a release pedal 101. The release pedal is secured to the front portion of the inner housing 71 using a release pedal pivot pin 103 passing through release pedal pin apertures 105. The release pedal 101 may be folded down to assist the user in extending or retracting the inner housing 71 or folded up for storage or otherwise non-use of the ladder 21. The configuration of the present invention allows the operator to apply a force to the inner housing 71 using the release pedal thus ratcheting the locking tip 91 along the locking hubs 49 as the inner housing 71 is extended from the outer housing 41. In the preferred embodiment, the lock block release lever 75 is preferably flush with the front portion of the outer housing 41, whereas the release pedal 101 extends outward from the front portion of the outer housing 41 and the inner housing 71.

It will be appreciated by those skilled in the art that the relationship between the inner housing 71, the outer housing 41, the lock block biasing spring 81 and the retraction spring 53 interconnecting the inner housing 71 and the outer housing 41 maintains the locking engagement of the lock block 73 into the locking hubs 49 at all times except when a downward force is applied by the user to the lock block release lever 75. More specifically, because the retraction spring is applying an upward force on the inner housing 71, if weight is removed from the ladder rail 29, the retraction spring 53 will prevent the inner housing 71 from, as a function of gravity, naturally extending from the outer housing 41.

Figure 6:
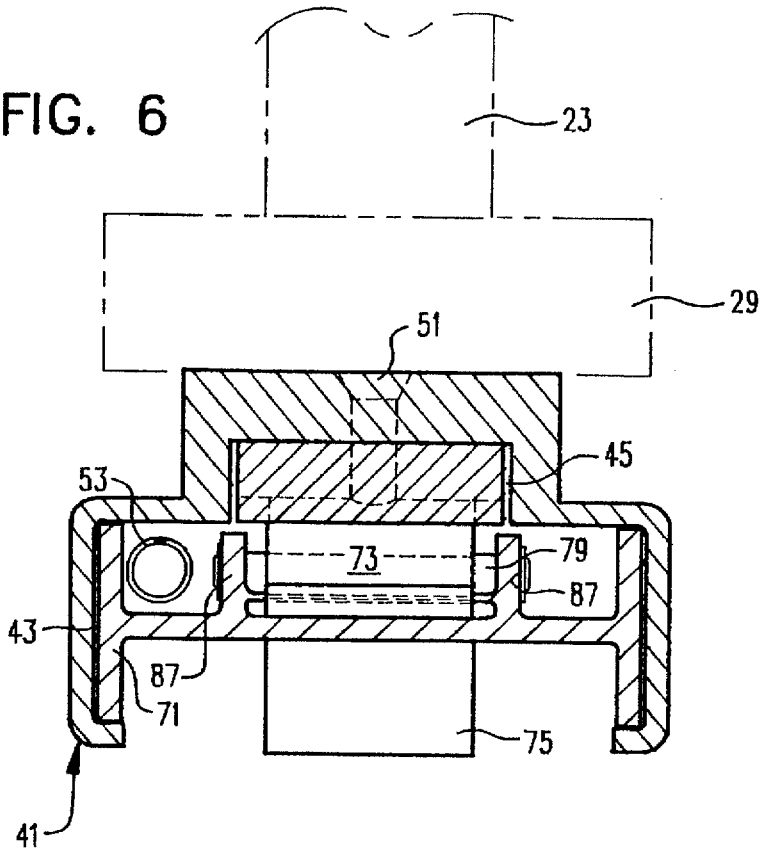
FIG. 6 is a top elevational view in partial cross-section of an upper portion of the preferred embodiment of the present invention showing the inner housing in relative relationship to the outer housing.
Figure 7:
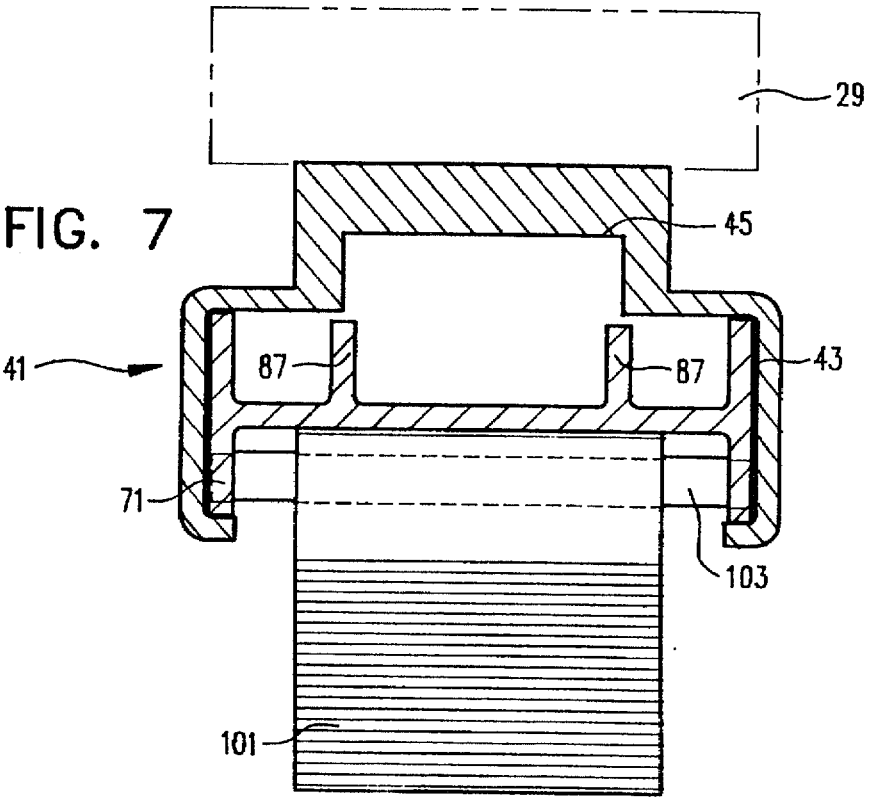
FIG. 7 is a top elevational view in partial cross-section of a lower portion of the preferred embodiment of the present invention showing the inner housing in relative relationship to the outer housing.

Referring now to FIG. 6 and FIG. 7, there are shown cross-sectional views of the present invention attached to the ladder rail 29. FIG. 6 shows a cross-sectional view of the top portion of the ladder stabilizing and leveling device illustrating the lock block 73, the lock block release lever 75 and the cooperative engagement of the inner housing 71 in the outer housing 41. FIG. 7 is a cross-sectional view of the bottom portion of the ladder stabilizing and leveling device showing the release pedal 101 in a substantially downward configuration, the release pedal 101 extending outward from both the inner housing 71 and the outer housing 41.

Ladders 21 are generally formed of either a square bar stock material, as shown in FIG. 1A and FIG. 2, or of a channel bar stock material as shown in FIG. 6 and FIG. 7. In this regard, it is a feature of the present invention to shape the outer housing 41 to be secured to either the square or channel configuration of ladder rails 29.

Figure 10:
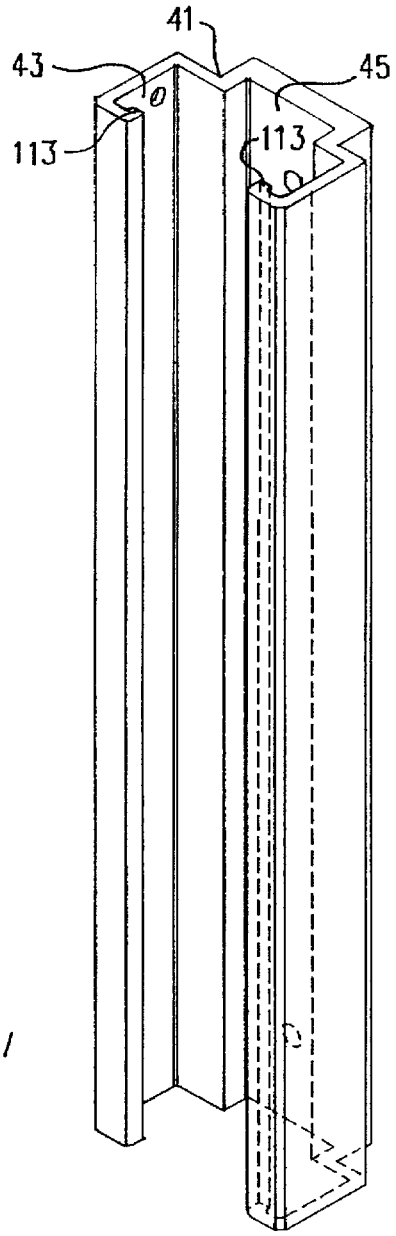
FIG. 10 is a perspective view of an alternative embodiment of the present invention showing the locking ridges on the outer housing.
Figure 8:
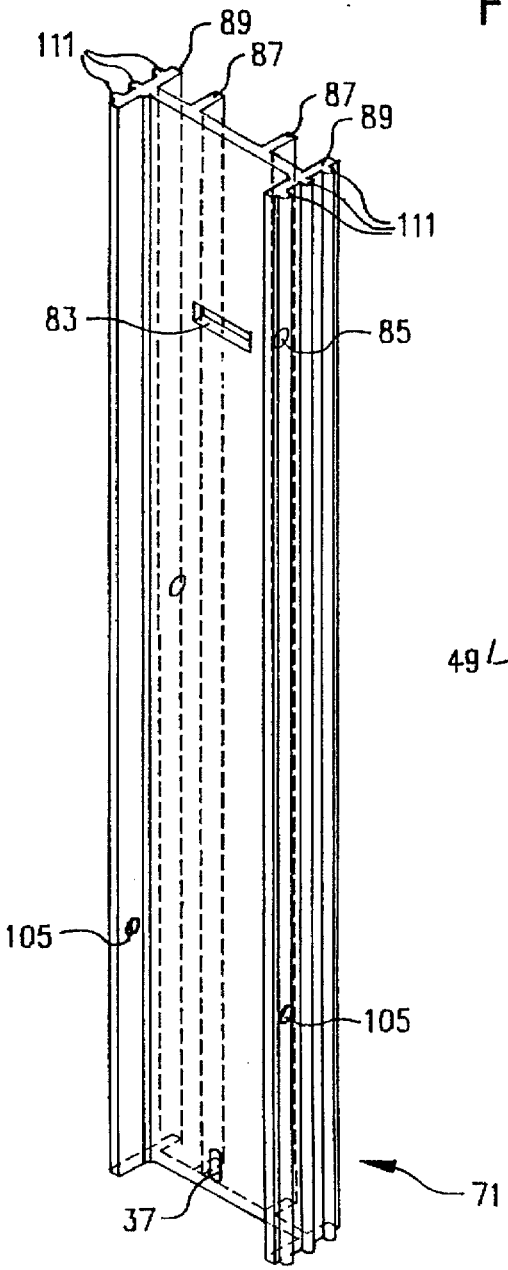
FIG. 8 is a perspective view of an alternative embodiment of the present invention showing the inner housing, and more specifically showing the contact ridges on the external surfaces of the inner housing for contacting the internal surfaces of the outer housing.
Figure 9:
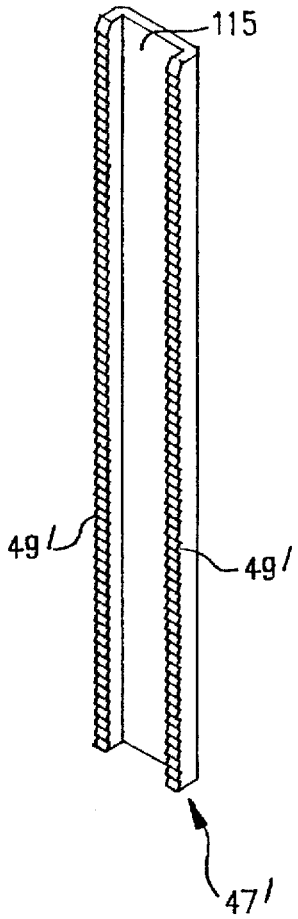
FIG. 9 is a perspective view of an alternative embodiment of the present invention showing an alternative locking nub rail for being positioned within the outer housing.

Referring now to FIG. 8, FIG. 9, and FIG. 10 there is shown an alternative embodiment of the present invention wherein ribs 111 are provided on the outer rails 89 of the inner housing 71. The ribs 111 are the primary contacting surface of the inner housing 71 with the outer housing 41. This configuration enables debris or other foreign particles that may inadvertently migrate into the interface between the outer housing 41 and the inner housing 71, to pass substantially downward, assuming the ladder 21 is in a substantial upright and vertical configuration, and exit the ladder stabilizing and leveling device at its bottom portion. In addition, and as shown in FIG. 9, the locking nub rail 47' may similarly include grooves 115 extending the longitudinal length of the locking nub rail 47'. In this regard, should debris or other foreign particles inadvertently migrate into the interface between the locking tip 91 of the lock block 73 and the locking nubs 49', the debris would have a natural tendency to work towards the grooves 115 and pass substantially downward through the ladder stabilizing and leveling device exiting at its bottom portion.

Shown in FIG. 10 is a locking feature of the outer housing 41 of the present invention, wherein the outer housing 41 includes a lip 113 turned inward to more firmly secure the inner housing 71 within the outer housing 41. Because the present invention includes an open front in the the outer housing 41, it is important to maintain the integrity, or otherwise, shape, of the outer housing 41 such that forces applied to the ladder stabilizing and leveling device do not cause the outer housing sides to flex thereby allowing the inner housing 71 to disengage from the outer housing 41. It would be readily apparent to those skilled in the art that other methods may be applied to securely ensure that the inner housing 71 is safely and securely maintained within the outer housing 41.

It will be readily apparent to those skilled in the art that the present invention is capable of many modifications. For example, the relationship between the inner housing 71 and the outer housing 41 may be reversed wherein the inner housing is substantially fixed to the ladder rail 29 and the outer housing 41 is longitudinally movable with respect to the ladder rails 29. In addition, the locking nub rail 47 may be any type of frictional surface wherein the lock block 73, rather than having a locking tip 91, merely incorporates a cam configuration wherein as additional weight is applied to the ladder 21, the lock block 73 is rotated in a direction that applies greater frictional forces to the locking nub rail 47 or otherwise frictional surface to provide a positive engagement locking system.

While the preferred embodiments of the present invention have been illustrated and described, it will be appreciated that various changes can be made thereto without departing from the spirit and scope of the invention.

The embodiments of the invention in which an exclusive property or privilege is claimed are defined as follows:

I claim:

1. A leg apparatus for being secured to a rail, the leg apparatus for stabilizing and leveling, comprising:

(a) a first longitudinal member having means for securing the longitudinal member to the rail;

(b) a second longitudinal member having a downward end and being longitudinally secured to and longitudinally movable with respect to the first longitudinal member from a retracted position to a plurality of extended positions;

(c) a foot attached to the downward end of the second longitudinal member;

(d) the first longitudinal member having a plurality of locking recesses, one of the plurality of locking recesses defining one of the plurality of extended positions;

(e) a lock block movably secured to the second longitudinal member, the lock block having a locking tip which matingly engages at least one of the plurality of locking recesses, and a release surface for releasing the locking tip from the at least one of the plurality of locking recesses; and (f) a safety bar connected to the foot and extending to the lock block such that, when a downward force on the second longitudinal member is resisted by the foot pushing against a surface, the safety bar engages the lock block and restricts its movement.

2. The leg apparatus of claim 1, wherein a biasing means biases the lock block against the locking recesses, the locking tip of the lock block continually engaging at least one of the plurality of locking recesses.

3. The leg apparatus of claim 1, wherein, when the locking tip is in the engaged position, increased weight on the rail increases the engagement force between the locking tip and the locking recesses.

4. The leg apparatus of claim 1, wherein the release surface is a release lever which protrudes outwardly from and is movably secured to the second longitudinal member such that pressing downwardly on the release lever releases the lock, further including:

(a) a spring connecting the second longitudinal member to the first longitudinal member such that a release of the lock allows the spring to urge the second longitudinal member in an upward direction with respect to the first longitudinal member.

5. A ladder with an extendable leg for stabilizing and leveling the ladder, comprising:

(a) a first longitudinal member;

(b) a second longitudinal member having a downward end and being longitudinally secured to and longitudinally movable with respect to the first longitudinal member from a retracted position to a plurality of extended positions;

(c) a foot attached to the downward end of the second longitudinal member;

(d) the first longitudinal member having a plurality of locking recesses, one of the plurality of locking recesses defining one of the plurality of extended positions;

(e) a lock block movably secured to the second longitudinal member, the lock block having a locking tip which matingly engages at least one of the plurality of locking recesses when in an engaged position, and a release surface for releasing the locking tip from the at least one of the plurality of locking recesses; and (f) a safety bar connected to the foot and extending to the lock block such that, when a downward force on the second longitudinal member is resisted by the foot pushing against a surface, the safety bar engages the lock block and restricts its movement.

6. The ladder of claim 5, wherein a biasing means biases the lock block against the locking recesses, the locking tip of the lock block continually engaging at least one of the plurality of locking recesses.

7. The ladder of claim 5, wherein, when the locking tip is in the engaged position, increased weight on the ladder increases the engagement force between the locking tip and the locking recesses.

8. The ladder of claim 5, wherein the release surface is a release lever which protrudes outwardly from and is movably secured to the second longitudinal member such that pressing downwardly on the release lever releases the lock block, further including:

(a) a spring connecting the second longitudinal member to the first longitudinal member such that a release of the lock block allows the spring to urge the second longitudinal member in an upward direction with respect to the first longitudinal member.

* * * * *